US006050517A

United States Patent [19]

Dobrescu et al.

[11] Patent Number: 6,050,517

[45] Date of Patent: Apr. 18, 2000

[54] COUNTERBALANCED WEB ACCUMULATOR

[75] Inventors: Alexandru Dobrescu, Hallandale; Erik Harikkala, Lake Worth, both of Fla.

[73] Assignee: Curt G. Joa, Boynton Beach, Fla.

[21] Appl. No.: 09/158,595

[22] Filed: Sep. 22, 1998

[51] Int. Cl.[7] ..... B65H 20/34

[52] U.S. Cl. ..... 242/417.2; 226/118.2

[58] Field of Search ..... 226/118.2, 118.3, 226/113; 242/417.2, 552

[56] References Cited

U.S. PATENT DOCUMENTS

| | | | |
|---|---|---|---|
| 3,796,360 | 3/1974 | Alexeff | 226/118.2 |
| 3,904,147 | 9/1975 | Taitel et al. . | |
| 4,009,814 | 3/1977 | Singh | 226/113 |
| 4,142,626 | 3/1979 | Bradley . | |
| 4,157,934 | 6/1979 | Ryan et al. . | |
| 4,168,776 | 9/1979 | Hoeboer . | |
| 4,215,827 | 8/1980 | Roberts | 226/118.2 |
| 4,223,822 | 9/1980 | Clitheroe | 226/118.3 |
| 4,374,576 | 2/1983 | Ryan . | |
| 4,776,920 | 10/1988 | Ryan . | |
| 5,163,594 | 11/1992 | Meyer | 226/118.2 |
| 5,865,393 | 2/1999 | Kreft et al. | 226/118.2 |

*Primary Examiner*—John M. Jillions
*Attorney, Agent, or Firm*—Ryan Kromholz & Manion

[57] ABSTRACT

A linear web accumulator is provided wherein a web is threaded alternately between two sets of movable rollers. Each set of movable rollers is connected to the other through a mechanical connection, so that relative motion of the sets is always simultaneously toward each other or away from each other. The connection places one of the sets of rollers in counterbalance against the opposite set, thereby canceling the effects of gravity. Force can be applied to the carriages to adjust web tension, for example, by a rotational drive means such as a servomotor.

11 Claims, 6 Drawing Sheets

FIG. 5
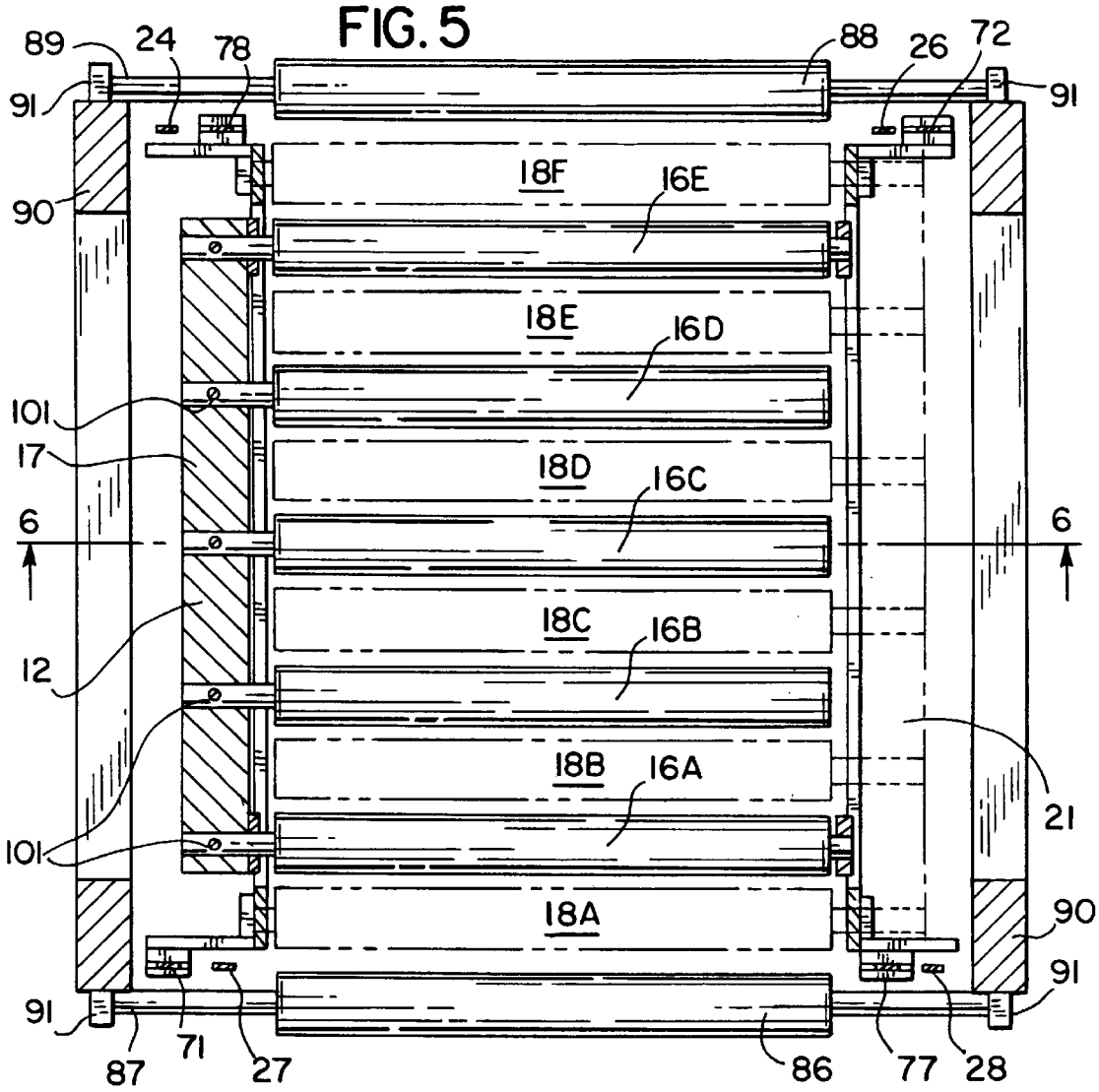
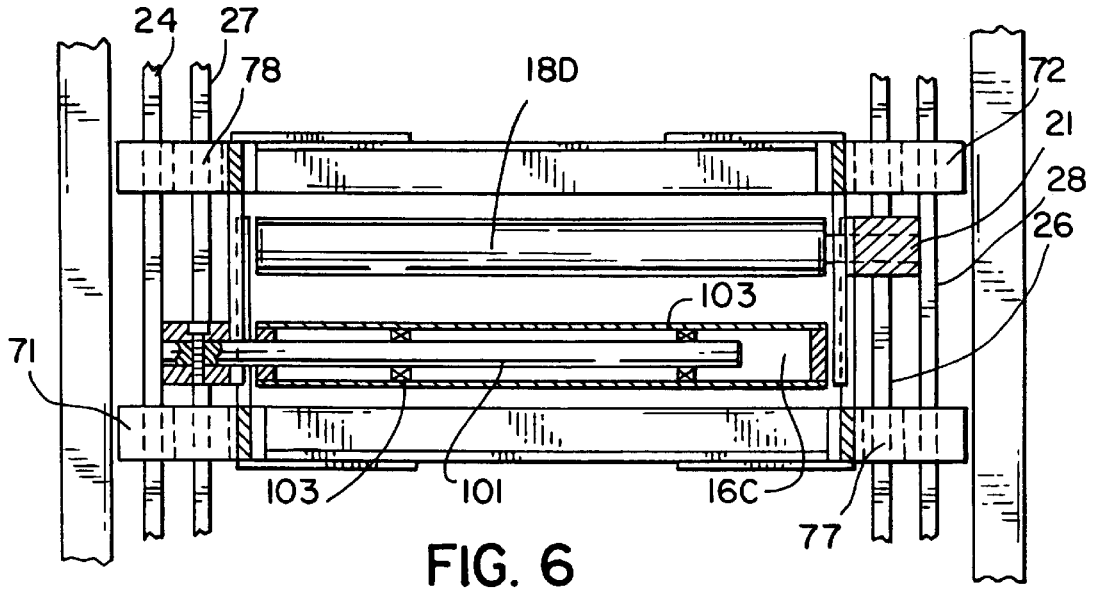
FIG. 6

COUNTERBALANCED WEB ACCUMULATOR

BACKGROUND OF THE INVENTION

The invention pertains to an accumulator for accumulating a substantial length of a running web such that if the infeed to the accumulator is stopped or slowed for a short interval, the web in storage is paid out continuously to a web-utilizing device so the device has a constant supply and thus need not be stopped or slowed.

One common use of a web accumulator is where a web is fed from a primary supply reel and it is necessary to splice the leading end of the web from a standby supply reel to the trailing end of a web from the primary supply reel in a manner which will not cause interruption of the web supply to a web consuming or utilizing device. In some known accumulators there is a row of spaced apart rollers on a movable carriage which cooperate with another row of stationary rollers.

When the support with a row of spaced apart rollers is moved away from the stationary rollers and the web is looped around the two sets of rollers in serpentine fashion, a substantial length of web can be accumulated. During running of the web, the rollers will be urged to their maximum separation from each other for accumulating and storing a maximum length of web. If the supply of web to the accumulator is stopped for a short time, the tension due to drawing web from the outfeed end of the accumulator causes the sets of rollers to move toward each other while the length of web in storage is paid out. After infeed to the accumulator is restored, the sets of rollers separate again to accumulate and store another length of web.

The forces of gravity and the weight of the movable roller assembly must be considered when configuring such a system. When oriented horizontally, gravity applies bending and binding forces which resist motion. When oriented vertically, gravity applies a linear force which tends to push the moving roller assembly down.

In accumulators which "accumulate down", web tension must overcome gravity to pull web from the system. In accumulators which "accumulate up", the device used to induce tension must overcome gravity to raise the moving roller assembly. Where the tensioning device must overcome gravity, it must do so reliably. The tensioning force is taken from that part which exceeds the force required to overcome gravity. Where the weight is significant, the force must be significant and the margin for error is necessarily also significant. This means that any excess force required for overcoming friction and other inertial forces must be taken from that part of the force reserved for web tensioning. This reduces the resolution needed for making fine adjustments in tension. It can therefor be seen that a system in which gravity is not a factor would be capable of more accurate tension control and be effectively used with more fragile webs.

The consequences of friction and inertia may be appreciated when it is realized that the web may be running at a very high rate of speed when suddenly, for some reason, such as when making a splice, the infeeding web is stopped or decelerated. This change in web motion will result in a reaction by the components of the accumulator. Most notable of these reactions is the motion imparted to the movable assembly of the accumulator. Minimization and control of the inertia and friction associated with this reaction is an important desired attribute of such accumulators. There is an important need for a web accumulator which provides the benefits of low friction and minimized inertia, allowing it to handle the most delicate of webs at high speeds without breakage or loss of control.

Gravity can be made a non-factor by arranging the system in a balanced or counterbalanced mode. Counterbalances applied to a traditional accumulator add mass without adding storage. The moving roller assembly must still move at the same velocities and while the effects of gravity have been canceled, the web must accelerate the inertia of twice as much mass.

SUMMARY OF THE INVENTION

This invention serves to combine the advantages of counter-balancing with additional storage by using the opposite set of rollers as a moving counterbalance. The effects of gravity are canceled without adding inertia to the system. Although the absolute inertia of the moving assemblies is effectively doubled, the reflected inertia felt by the web is the same, since the assemblies move half as fast.

In general terms, the preferred new dual opposed carriage web accumulator includes a superstructure on which are arranged first and second driven axle shafts with their axes in parallel spaced from each other along a common center line. A pair of carriages are arranged for traveling toward and away from each other along a common axis. The carriages generally each support a number of rollers, preferably in cantilevered fashion. Web is looped back and forth in serpentine fashion between the rollers on one carriage and rollers on the other carriage. Means are provided for applying a torsional force concurrently to the axle shafts which causes one of the carriages to travel through an distance away from one side of the center line and the other carriage to travel away through a corresponding distance from the other side of the initial center line until the carriages attain a maximum permissible distance relative to the center line during normal running of the web. The carriages also travel correspondingly toward each other as stored web in the accumulator is withdrawn from the accumulator.

As with many previous accumulators, the carriages can travel past each other to provide an open space into which the web is threaded initially through the free space between the two sets of rollers on the carriages but without the need to loop the web around the rollers. When the carriages travel to opposite sides of each other, accumulating loops are automatically formed.

The most important feature of the new accumulator is that the carriages are tied together mechanically such that they are effectively counterbalanced to entirely negate the effects of gravitational forces. Another important feature of the new accumulator is that, unlike many prior art accumulators, both carriages are movable, and are coupled together in a manner which prevents them from moving independently of each other.

In a preferred embodiment, the movable roller assembly-supporting carriages are arranged in a vertical orientation, so that the motion of the respective assemblies is along a vertical axis. The assemblies are designed to be very nearly identical in weight so that they counter-balance each other.

A flexible mechanical linkage which connects one assembly to the other may be a loop of roller chain, timing belt or similar device which is driven by the axle shafts. Loops are configured so that motion in one movable assembly results in opposing motion by the opposite assembly. Multiple loops may be provided to add side-to-side stability. Linear force, whether to induce tension or to control position or velocity, may be applied through the shafts which support and drive the flexible linkage.

In accordance with a further embodiment, the carriage assemblies can be tied together by means of a mechanical linkage system, for example by using racks connected to each carriage assembly which engage a common pinion gear.

An example of a mechanism which can be used to induce tension is a constant or variable speed motor, coupled to the flexible linkage through a magnetic clutch. Use of an electrically controlled magnetic clutch enables the user to vary the force and hence the web tension as desired. This arrangement allows application of a constant force or torque to the flexible linkage, but cannot impart a higher velocity than that at which the motor is running, a particularly useful feature if the web were to break.

In accordance with a further embodiment a servo motor is used as a torque producing device. The selected servo drive preferably is capable of limiting velocity in event of web breakage.

Another, more traditional, means for inducing a tensioning force is the installation of an air cylinder with its output shaft applying a linear force to the accumulator. Similar less sophisticated tensioning devices can be constructed out of counterweights or springs, as will be apparent to those skilled in the art.

Further features and objectives of the invention will appear in the ensuing detailed description of the invention, the claims and the accompanying drawings.

BRIEF DESCRIPTION OF THE DRAWINGS

FIG. 5 is a top view of the accumulator of FIG. 2 showing roller carriages in cross section along Line 5—5;

FIG. 6 is a sectional view taken along Line 6—6 of FIG. 5 showing the pass-through threading area;

DETAILED DESCRIPTION OF THE INVENTION

Figure 1:
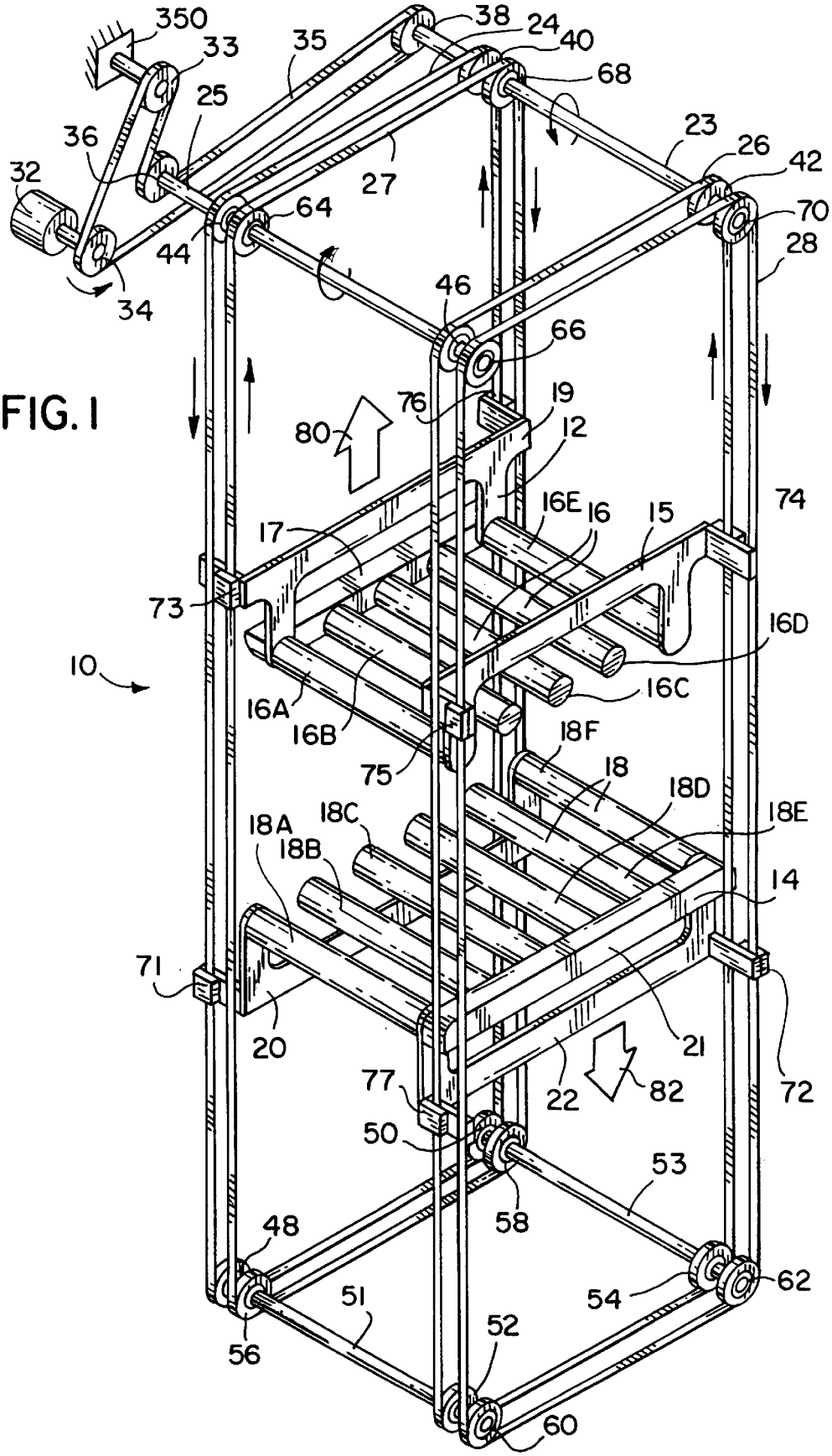
FIG. 1 is a diagrammatic isometric view of a preferred embodiment, showing an arrangement of moving carriages and the flexible members but with the supporting housing omitted.

FIG. 1 illustrates in overall fashion the interconnection between the interconnecting mechanism of the new accumulator, generally designated by the numeral 10, and the movable sets of rollers 16 and 18. Details relating to the interaction between a moving web and the accumulator are set forth in commonly owned U.S. Pat. No. 5,163,594, which disclosure is incorporated by reference.

An upper movable carriage 12 supports a set of web accumulator rollers 16 which are individually identified as rollers 16A–16E, inclusive. The carriage 12 includes a roller support bar 17. In the illustrated embodiment individual rollers 16B–16D are supported on bar 17 in cantilevered fashion, whereas the end rollers 16A and 16E are rotatably supported on both ends, for example, by plate 15. Thus the entry and exit rollers 16A and 16E are non-cantilevered. This arrangement provides mechanical stiffness to the design but is not required for the practice of the invention, since all of the rollers may be cantilevered, if desired.

The lower carriage 14 supports a second set of rollers 18, individually identified as rollers 18A–18F inclusive. Carriage 14 includes a support bar 21 which supports rollers 18B–18E in cantilevered fashion. The entry and exit rollers 18A and 18F as illustrated are supported at both ends in non-cantilevered fashion by support plates 20 and 22. Rollers 18 could also be entirely supported in cantilevered fashion if desired.

It will also be noted that in the illustrated embodiment a set of rollers 16 includes 5 rollers and set 18 includes 6 individual rollers. This number can be, of course, varied using either a lesser or greater number of rollers as selected for a particular application.

A pair of rotatable drive shafts 23 and 25 are provided for the purpose of imparting motion to the carriages carrying the sets of rollers. In the illustrated embodiment, two pairs of notched timing belts 24, 26, 27 and 28 are reeved over a series of notched pulleys mounted on drive shafts 23 and 25. The first pair of timing belts 24 and 26 is movable only in a direction opposite to that of the second pair 27 and 28. To that end, it will be noted that drive belt 35 is driven by a drive motor such as servomotor 32 which drives a pulley 34 which in turn drives belt 35 in the direction indicated by the arrow in FIG. 1. By virtue of the manner in which belt 35 is threaded, pulley 36 which is mounted on drive shaft 25 causes shaft 25 to be rotated clockwise when viewed from the right in FIG. 1. Conversely, pulley 38 mounted on shaft 23 causes counterclockwise rotation of shaft 23 when viewed from the right in FIG. 1.

The appropriate direction of motion is imparted to the pairs of drive belts as best seen in FIG. 1. A pair of pulleys 40 and 42 are fixed to rotating shaft 23 by means of mechanical fasteners such as set screws, keys fitted in a keyway, pins, etc. This causes timing belts 24 and 26 to be rotated in unison with shaft 23. Belts 24 and 26 travel over idler pulleys 44 and 46 which are rotatably mounted on shaft 25 utilizing appropriate rotatable bearings is shown in greater detail in FIGS. 7 and 8.

Lower shafts 51 and 53 are provided with a series of idler pulleys 48, 50, 52, 54, 56, 58, 60 and 62 to allow free travel thereover of each of the timing belts 24, 26, 27 and 28. Belts 27 and 28 are driven in opposite directions relative to belts 24 and 26 by pulleys 64 and 66 which are affixed to rotatable drive shaft 25. Belts 27 and 28 are allowed to travel in a direction opposite to the rotation of shaft 23 by means of idler pulleys 68 and 70 which are rotatably mounted on shaft 23. Thus, when belt 35 is caused to travel in the direction illustrated, the pairs of timing belts 24, 26 and 27, 28 will travel in opposite directions as indicated by the arrows. This movement accommodates web accumulation whereas movement in the opposite direction occurs during web pay out.

Carriages 12 and 14 are affixed to the timing belts in the manner illustrated in order to assure that they will not move independently of each other and can only move simultaneously in opposite directions. For that purpose, carriage 12 is affixed to belt 27 by a clamp 73. At its opposite edge it is affixed to belt 24 by a clamp 76. In similar fashion, clamp 74 affixes carriage 12 to belt 26 while clamp 75 on the opposite side connects carriage 12 to belt 28. Similarly, belt 24 is connected to carriage 14 by means of clamp 71 and carriage 14 is connected on its opposite edge to belt 27 by a clamp 78 (FIG. 5). Clamp 72 connects belt 28 to one side of carriage 14 and clamp 77 affixes belt 26 to the opposite end thereof. It will be readily apparent from this arrangement that carriage 12 moves upwardly in the direction of arrow 80 while carriage 14 moves downwardly in the direction of arrow 82. The carriages 12 and 14, thus, in the position illustrated in FIG. 1 are moving apart causing sets of rollers 16 and 18 to accumulate more web. The sets of rollers 16 and 18 will move in directions opposite of arrows 80 and 82 in order to feed additional web from the accumulator to the traveling web.

Figure 2:
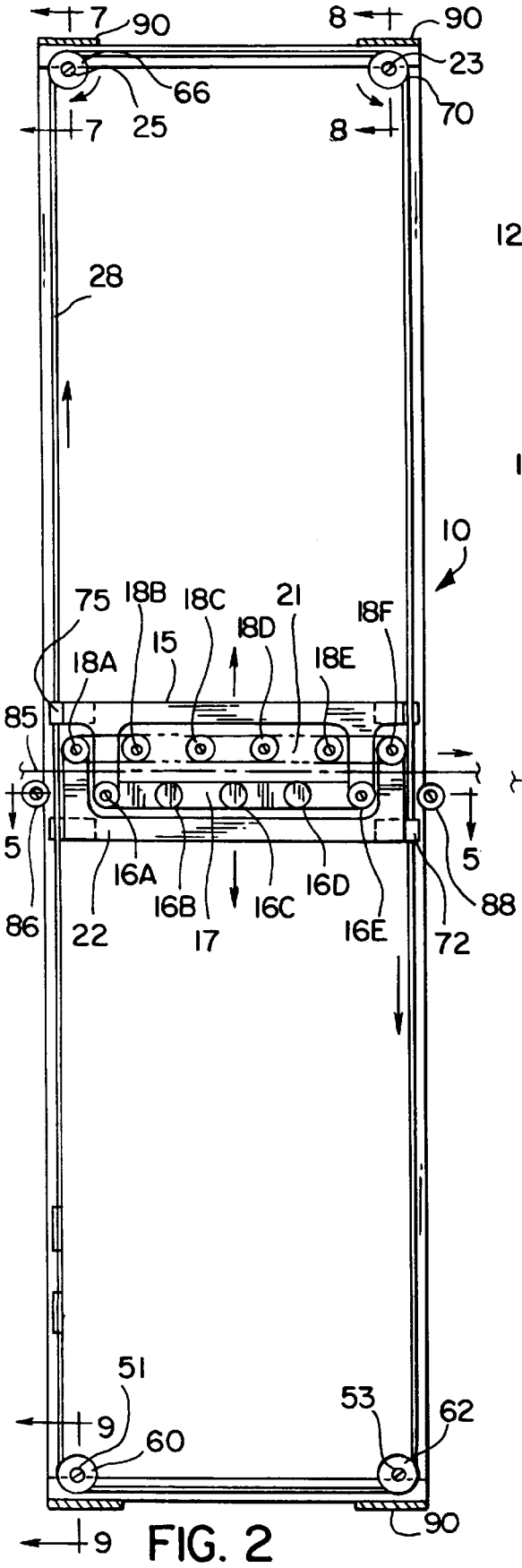
FIG. 2 is a side elevational view of an accumulator, shown in the thread up position.
Figure 3:
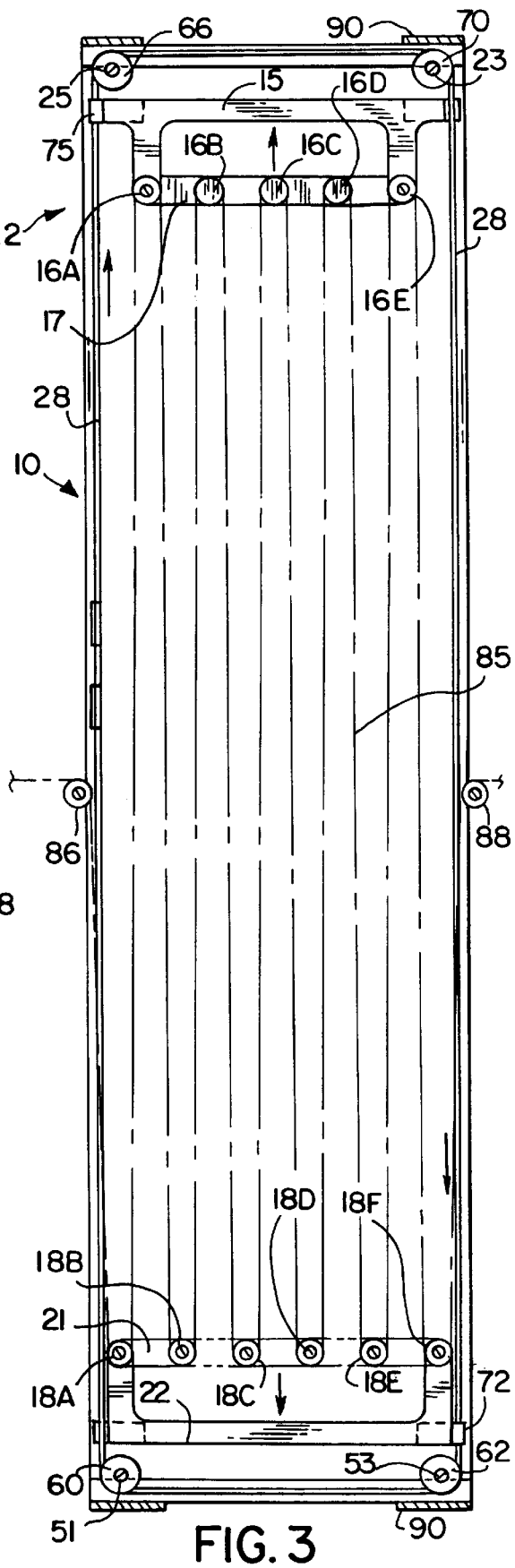
FIG. 3 is a side elevational view of the accumulator of FIG. 2 shown in its maximum web storage position.
Figure 4:
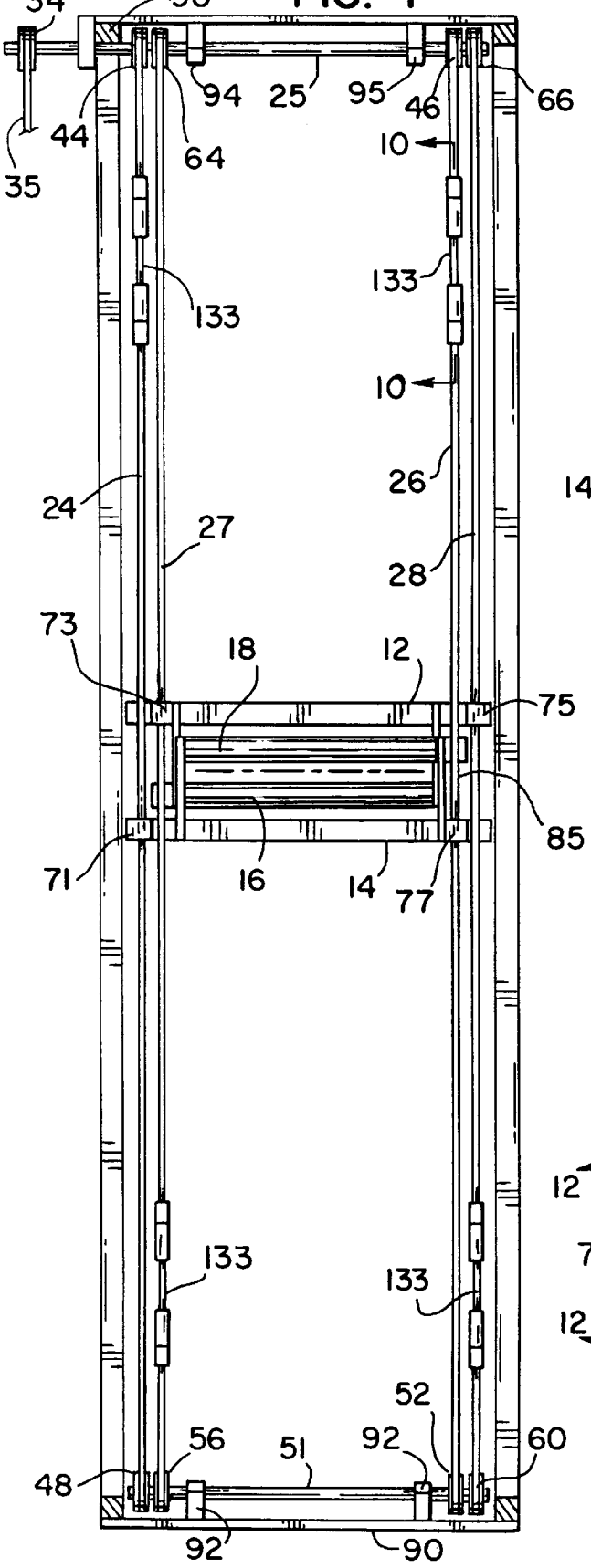
FIG. 4 is an elevation view of the accumulator of FIG. 2 and shown with the carriages in the thread up position and viewed parallel to the web axis.

Referring to FIG. 2, the carriages are shown with the rollers in the thread up position. In this position the sets of rollers 16A-16E and 18A–18F have traveled past each other, providing a threading up space or opening therebetween for insertion of web 85. Note that as the carriages are moved away from each other, ultimately to the position shown in FIG. 3, that the web is automatically formed into a serpentine or zigzag orientation which enables a substantial length of web 85 to be accumulated. In the position shown in FIG. 3, the accumulator is in its maximum storage position whereas in FIG. 2 it is in a least or zero storage position. Idler rollers 86 and 88 are positioned at the entrance and exit sides of the accumulator 10, respectively, to serve as guides for web 85 as it enters and leaves the accumulator. As best seen in FIGS. 2–4, a supporting housing or superstructure 90 is provided for the purpose of supplying a support for the various axle shafts 23, 25, 51, and 53 which form working components of the accumulator, as well as other components described below. Support brackets 92 and 94 are provided for support of the various axle shafts. Note that the movable carriages 12 and 14 are supported substantially by the belts 24, 26, 27 and 28, as well as, during use, by the web 85, itself.

Figure 7:
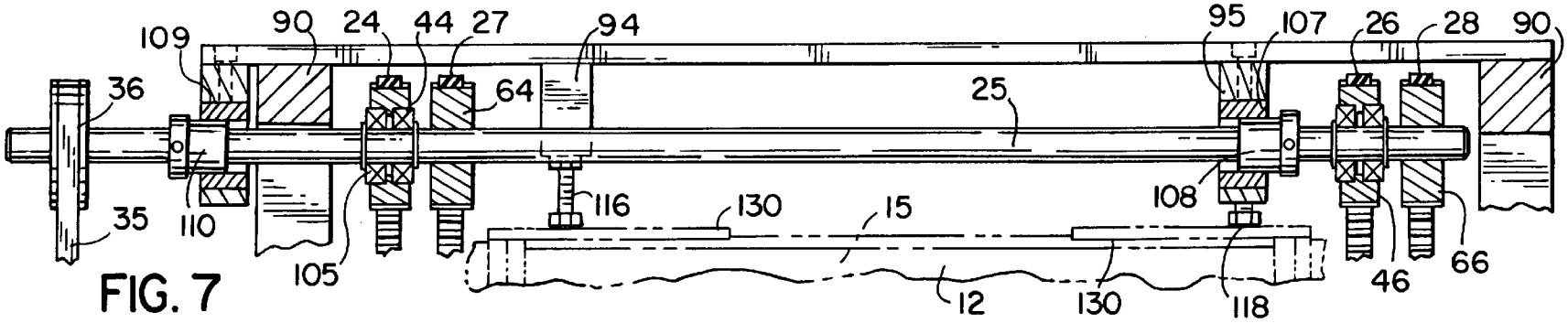
FIGS. 7 and 8 are sectional views of the top axles taken along Lines 7—7 and 8—8 of FIG. 2, showing how each axle drives one pair of pulleys, while providing axial support for the opposite pair of idler pulleys.
Figure 8:
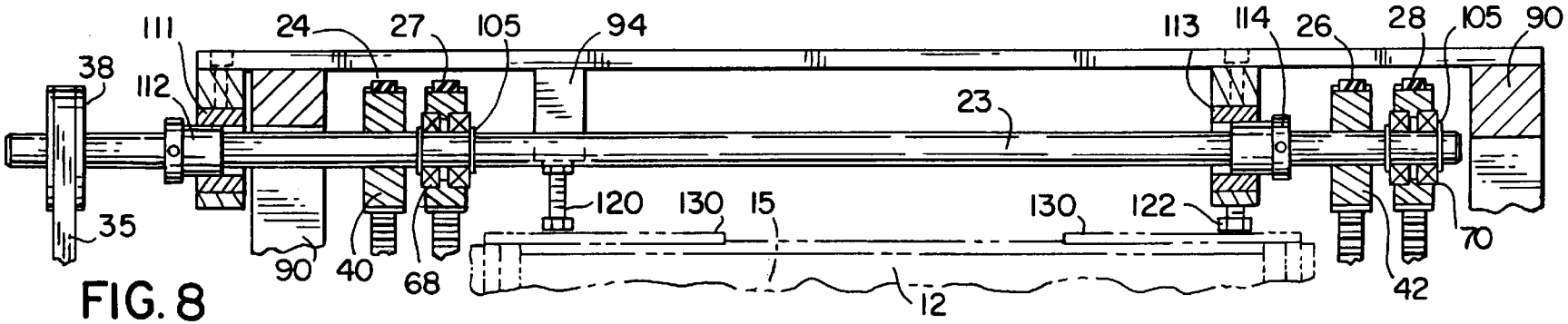
Figure 9:
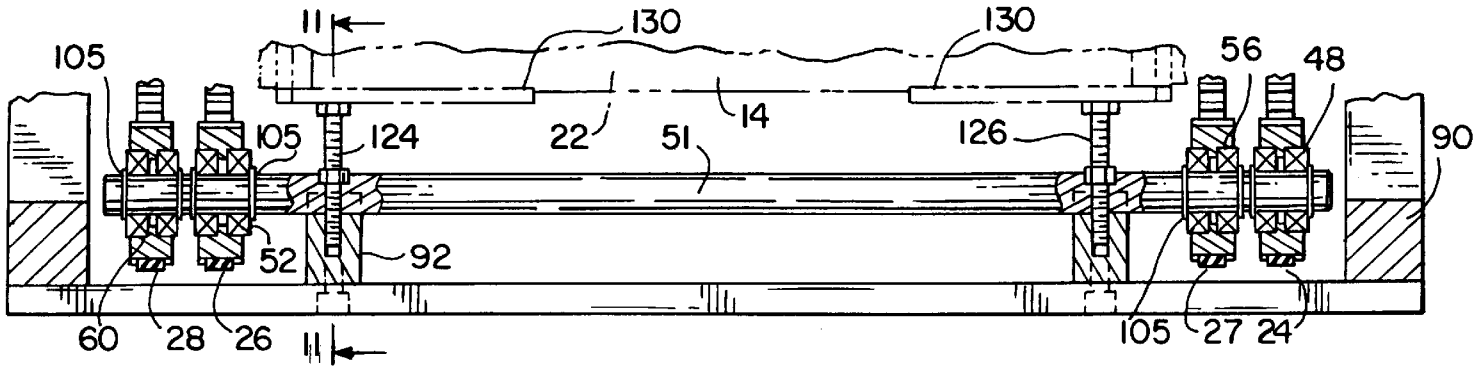
FIG. 9 is a sectional view taken along Line 9—9 of FIG. 2 showing that all pulleys on the lower shafts are installed as idlers.

The details of the sets of rollers 16 and 18 which are of known configuration is shown in greater detail in FIGS. 5 and 6. Each of the rollers is rotatably mounted on a shaft 101 and provided with internal bearings 103. Also, end rollers 86 and 88 are supported by shafts 87 and 89 which in turn are supported on brackets 91 affixed to superstructure 90. FIGS. 7 and 8 show how shafts 23 and 25 are supported on superstructure 90 for rotation. Also seen are details of positioning on shaft 25 of rotatable pulleys 44 and 46 and on shaft 23 of pulleys 68 and 70. In each case a pair of positioning washers or split rings 103 secures the pulleys in place on the shaft 23 or 25. Also, as seen, the shaft is rotationally held within bearings 107, 109, 111 and 113 which are held in position by collars 108, 110, 112 and 114, each of which is adjustably secured to its shaft by means of a set screw as illustrated. Bearings 48, 56, 52, and 60 are fixed in placed in place for rotation on shaft 51 by split washers 105 as seen in FIG. 9. The rotatable pulleys on shaft 53 are arranged in similar fashion (not illustrated).

Figure 11:
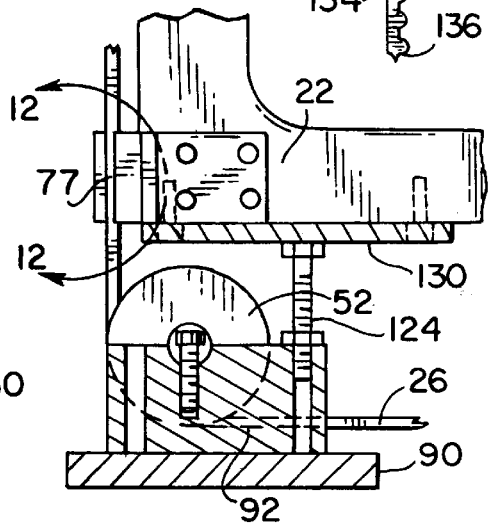
FIG. 11 is a sectional view taken along Line 11—11 of FIG. 9 showing one of the idler axles installed at the bottom corners of the preferred embodiment, showing its relationship to the carriage, the mechanical stop for the carriage and the connection of a flexible member to the carriage.

Also illustrated in FIGS. 7 and 8 are adjustable motion limiting bolts 116, 118, 120 and 122 which serve to limit the upward movement of carriage 12. Similar adjustable bolts 124 and 126 are provided at the base of housing 92 to limit downward movement of carriage 14. Plates 130 are preferably added to each of the carriages in alignment with the adjustable bolts to serve as a positive stop surfaces. Each of the adjustable bolts is adjusted so as to simultaneously stop the upward movement of carriage 12 and the downward movement of carriage 14 at the maximum position of accumulation illustrated in FIG. 3. Further details of the adjustable stops are seen in FIG. 11 wherein details of the lower idler pulleys are also shown.

Figure 10:
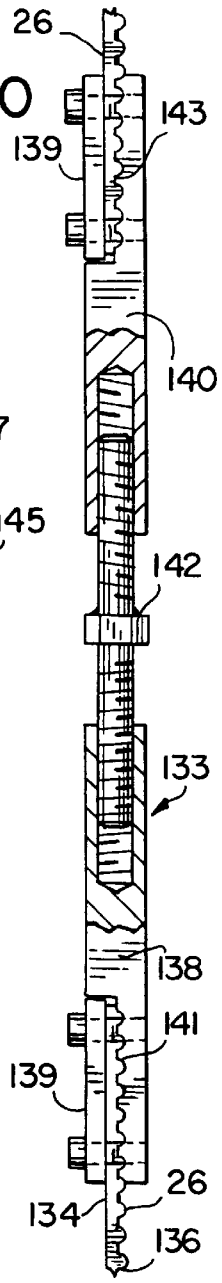
FIG. 10 is a sectional view along Line 10—10 of FIG. 4 showing a "turnbuckle" connection used to take up slack in the illustrated flexible connection system.
Figure 12:
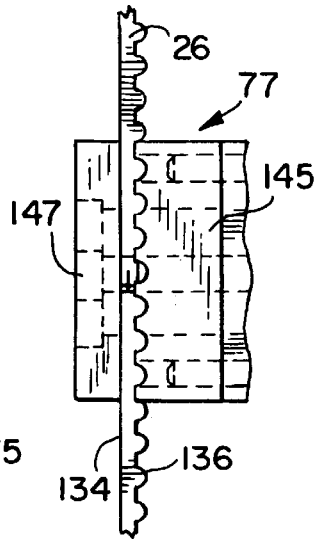
FIG. 12 is an enlarged fragmentary view of the parts encircled by Arc 12—12 of FIG. 11 detailing clamp connecting a flexible timing belt to the carriage.

Referring to FIGS. 10 and 12 there are seen details of the timing belts used in the preferred embodiment. As is conventional for such belts, belt 26 which is illustrated has a flat surface 134 and an opposite surface with a plurality of teeth 136. The teeth 136 are used to facilitate and provide adjustability to the length of belt 26 as seen in FIG. 10. A turnbuckle arrangement is provided by clamping components 138 and 140 which each have an end connecting portion 141 and 143, respectively, which matingly receives the teeth 136 of timing belt 26. Retaining brackets 139 are clamped to connecting portions 141 and 143 by bolts or screws as shown. Clamping components 138 and 140 have oppositely threaded sockets to receive oppositely threaded ends of a double ended bolt 142, which can thus be rotated to shorten or lengthen the timing belt 126 as needed. The complete illustrated turnbuckle connector is generally identified by numeral 133.

Referring to FIG. 12 the details of clamp 77 are shown, for purposes of illustration, all of the similar clamps 71–78 being of similar construction. In this case, the clamp 77 is formed by two components 145 and 147 which are provided with a channel between them configured to receive matingly the toothed belt 26. The teeth 136 are thus retained within the mating depressions in clamp component 145 when the belt 26 is confined there against by means of the cooperating clamping component 147. The series of clamps shown in the various figures thus positively locate the positions of the carriages 12 and 14 relative to the timing belts 24, 26, 27 and 28.

Figure 13:
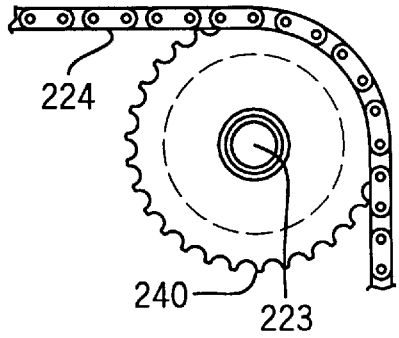
FIG. 13 is a fragmentary view of a roller chain-sprocket combination which may be used instead of timing belts illustrated in FIGS. 1–12; and, FIG. 14 is a diagrammatic view of a further embodiment of the invention which utilizes racks and pinions instead of flexible interconnecting elements.

As an alternate to toothed timing belts and toothed pulleys, the flexible means for interconnecting the sets of rollers 16 and 18 can be a roller chain 224 of the general type illustrated in FIG. 13. In this case a sprocket 240, which intermeshes with the roller chain 224, is mounted on shaft 223, which is utilized similarly to illustrated shaft 23. Any convenient drive mechanism such as a servomotor 32 may be employed to impart rotational forces to the shaft 223 and to a related cooperating shaft (not shown). In other respects the design is similar to that shown in FIGS. 1–12 but with appropriate modifications made, by those skilled in the art, to adapt the modified device to a series of chains 224 in place of the previously illustrated toothed timing belts.

Figure 14:
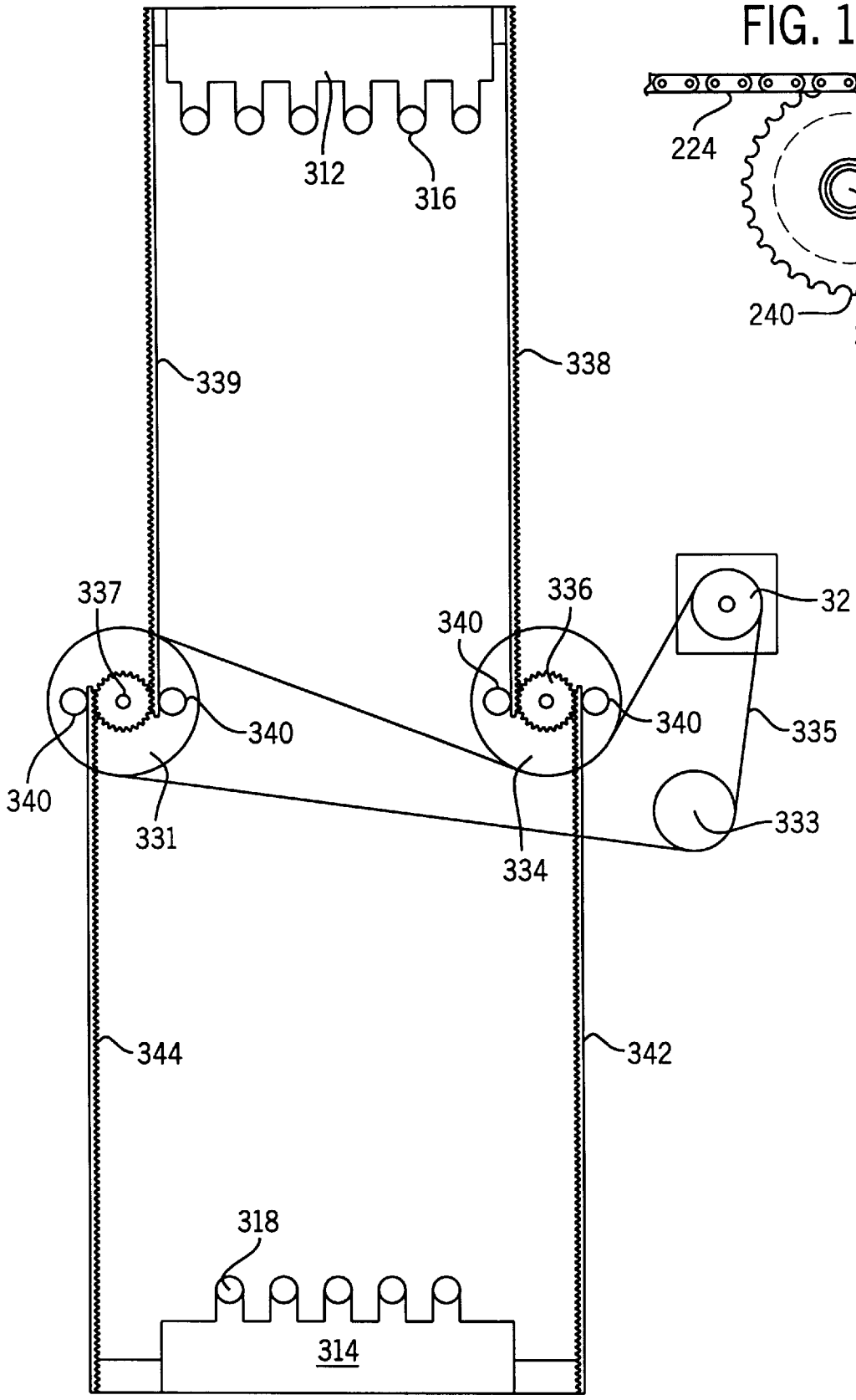

Referring to FIG. 14, there is shown an alternate mechanism for tying together a pair of carriages 312 and 314 which carry opposed, cooperating sets of rollers 316 and 318 used in connection with the practice of the invention, in accordance with an alternative embodiment. In this alternative embodiment, servomotor 32, or its equivalent, drives a belt 335 which is threaded over pulleys 331 and 334 to drive them and attached gears 337 and 336, respectively, in opposite rotational directions. Idler pulley 333 is used to complete the travel path of belt 335 and, if desired, may be attached to a potentiometer. Pinion gears 336 and 337 intermesh with toothed racks 338 and 339, which support the upper carriage 312, and on opposite sides with toothed racks 342 and 344, which are affixed at their lower ends to carriage 314, which, in turn, supports a lower set of rollers 318. As will be appreciated by those skilled in the art, this arrangement also makes it impossible for the carriages 312 and 314 to be moved except simultaneously and in opposite directions either toward or away from each other. Accordingly, this arrangement also is adapted for use in conjunction with the invention. In the illustration, each of the racks 338, 339, 342 and 344 is backed by a cam follower bearing 340 which holds the toothed racks against the toothed pinion gears 336 and 337, as shown.

Referring again to FIG. 1, pulley 33 is fastened to the shaft of a potentiometer 350. The potentiometer produces an analog signal relating to the position of the carriages. This analog signal is typically supplied to the infeed device's web speed controller, not shown. In the application depicted in FIG. 1, the motor 32 applies a constant torque to shafts 23 and 25.

Instead of motor 32, it will be appreciated that force can be applied to the carriages 12 and/or 14 directly to bias them for movement either toward or away from each other. Such forces can be applied, for example, by use of a linearly acting mechanism such as a pneumatically actuated cylinder which is controlled to exert either upward or downward forces.

One mode of operation for the accumulators of this invention might be to induce a controlled tension into the subject web by applying a controlled linear force in a direction which drives the moving assemblies apart. In this mode, it is typical for the control system to vary the velocity of either the infeeding or outgoing webs to regulate the nominal running position of the accumulator.

Another, less common, form of control uses the accumulator only as a storage device and not to apply tension to the web. This mode of operation varies the position or velocity of the accumulator with the differences in displacement between the incoming and outgoing webs. Web tension' regulation is accomplished elsewhere in the system. The accumulator simply provides a variable-length path for the web.

A variant of the above-mentioned displacement control, and one which is closely analogous to typical web supply systems, uses a dancer or load cell for feedback at the discharge of the accumulator. The effect of this arrangement is that the accumulator is treated as a supply device. Tension at the outfeed is regulated by varying the speed of the accumulator assemblies relative to each other. The basis accumulator velocity is a function of the difference between the infeed velocity and the discharge velocity while the feedback signal is used as a trim to regulate tension.

Although various implementations of the new accumulator have been described in detail, such description is intended to be illustrative rather than limiting, for the invention may be variously modified and is to be limited only by interpretation of the claims which follow.

We claim:

1. A web accumulator for accumulating and paying out a portion of a continuous moving web passing through the accumulator comprising first and second carriages mounted for movement toward and away from each other along a common axis;

a first set of rotatably mounted rollers carried by said first carriage;

a second set of rotatably mounted rollers carried by said second carriage, the rollers of said first and second sets being spaced from each other and away from said axis to facilitate looping of a web from a roller of the first set to a roller of the second set in consecutive order;

a mechanical connection interconnecting said carriages and limiting the movement of said carriages independently of each other and whereby said carriages are movable in equal amounts either toward or away from each other, said mechanical connection including first and second axle shafts attached, respectively, to said first and second carriages, a toothed wheel fastened to each axle shaft, and a flexible member affixed to each of said carriages and reeved around each said wheel and engaged with said wheel for causing translation of the flexible member and, a rotational drive means for applying a rotational force to one of said first and second axle shafts to selectively urge said carriages toward or away from each other whereby length of the travel said web can be controlled.

2. Apparatus according to claim 1 wherein said carriages are of approximately the same weight.

3. Apparatus according to claim 1 wherein said means for applying rotational force is a servomotor.

4. A web accumulator according to claim 1 wherein said flexible member is a toothed timing belt and each said wheel is a mating toothed pulley.

5. A web accumulator according to claim 1 wherein said flexible member is a roller chain and said toothed wheels are sprockets mating with said roller chain.

6. A web accumulator wherein a traveling web is threaded alternately between two sets of movable rollers, each set of movable rollers being supported on a carriage and connected to the other set through a mechanical connection, so that relative motion of said sets is always simultaneously toward each other or away from each other, said connection placing one of said sets of rollers in counterbalance against the opposite set, thereby canceling the effects of gravity, each of said carriages having an axle shaft affixed thereto, at least one flexible connector affixed to each of said carriages and reeved over first and second wheels mounted, respectively, on opposite ones of said axle shafts thereby limiting the movement of said carriages independently of each other and, means for applying a torsional force to one of said axle shafts to selectively urge said carriages toward or away from each other whereby length of the travel of said web can be controlled, a flexible member formed in a closed loop reeved around and engaged with said wheels for moving the carriages with said axle shafts in opposite directions concurrently through the same distance in response to translation of said flexible member.

7. An accumulator according to claim 6 wherein said wheels are toothed pulleys and said flexible member loop is a toothed timing belt.

8. An accumulator according to claim 6 wherein said means for applying a torsional force to said one axle shaft comprises a servomotor.

9. An accumulator according to claim 6 wherein said means for applying a torsional force to said one axle shaft comprises a torque motor coupled in driving relation to said one axle shaft.

10. A web accumulator for accumulating and paying out a portion of a continuous moving web passing through the accumulator comprising first and second carriages mounted for movement toward and away from each other along a common axis;

a first set of rotatably mounted rollers carried by said first carriage;

a second set of rotatably mounted rollers carried by said second carriage, the rollers of said first and second sets being spaced from each other and away from said axis to facilitate looping of a web from a roller of the first set to a roller of the second set in consecutive order;

a mechanical connection interconnecting said carriages and limiting the movement of said carriages independently of each other and whereby said carriages are movable in equal amounts either toward or away from each other, said mechanical connection comprising at least one toothed rack affixed to each of said carriages, said toothed racks being located on opposite sides of and having the teeth thereof in engagement with the teeth of a pinion wheel, whereby said toothed racks move in opposite directions when said wheel is rotated, and, means for applying a force to selectively urge said carriages toward or away from each other whereby length of the travel said web can be controlled.

11. An accumulator according to claim 10 wherein at least two pinion gears are provided and are located on opposite sides of said carriages, and a toothed rack meshing with each of said pinion gears is affixed to each of said carriages.

* * * * *